US010914042B2

(12) United States Patent
Cornelus et al.

(10) Patent No.: US 10,914,042 B2
(45) Date of Patent: Feb. 9, 2021

(54) STRUCTURE FOR THE REINFORCEMENT OF PAVEMENTS

(71) Applicant: NV Bekaert SA, Zwevegem (BE)

(72) Inventors: Henk Cornelus, Avelgem (BE); Peter Goemaere, Zwevegem (BE); Geert Braekevelt, Zwevegem (BE); Frederik Vervaecke, Ghent (BE)

(73) Assignee: NV BEKAERT SA, Zwevegem (BE)

( * ) Notice: Subject to any disclaimer, the term of this patent is extended or adjusted under 35 U.S.C. 154(b) by 271 days.

(21) Appl. No.: 15/513,658

(22) PCT Filed: Sep. 14, 2015

(86) PCT No.: PCT/EP2015/070921
§ 371 (c)(1),
(2) Date: Mar. 23, 2017

(87) PCT Pub. No.: WO2016/062458
PCT Pub. Date: Apr. 28, 2016

(65) Prior Publication Data

US 2017/0241085 A1 Aug. 24, 2017

(30) Foreign Application Priority Data

Oct. 23, 2014 (EP) ..... 14190087

(51) Int. Cl.
*E01C 11/16* (2006.01)
*B21F 27/00* (2006.01)
(Continued)

(52) U.S. Cl.
CPC ..... *E01C 11/16* (2013.01); *B21F 27/005* (2013.01); *B21F 27/08* (2013.01); *E01C 11/005* (2013.01);
(Continued)

(58) Field of Classification Search
CPC ..... E01C 11/16; E01C 11/165
(Continued)

(56) References Cited

U.S. PATENT DOCUMENTS 1,645,538 A * 10/1927 MacDonald ..... E01C 11/16 404/134
1,737,412 A * 11/1929 Dunker ..... E01C 11/16 404/21
(Continued)

FOREIGN PATENT DOCUMENTS

CH 224384 11/1942
DE 586079 C * 10/1933 ..... E01C 11/16
(Continued)

OTHER PUBLICATIONS

International Search Report dated Dec. 11, 2015 in International (PCT) Application No. PCT/EP2015/070921.

*Primary Examiner* — Thomas B Will
*Assistant Examiner* — Katherine J Chu
(74) *Attorney, Agent, or Firm* — Wenderoth, Lind & Ponack, L.L.P.

(57) ABSTRACT

The invention relates to a structure for the reinforcement of pavements. The structure is provided at predetermined positions with interruptions or with weakened zones. The invention further relates to a method of manufacturing such a structure and to a method of breaking up a pavement reinforced with such a structure.

17 Claims, 6 Drawing Sheets

Figure 1:
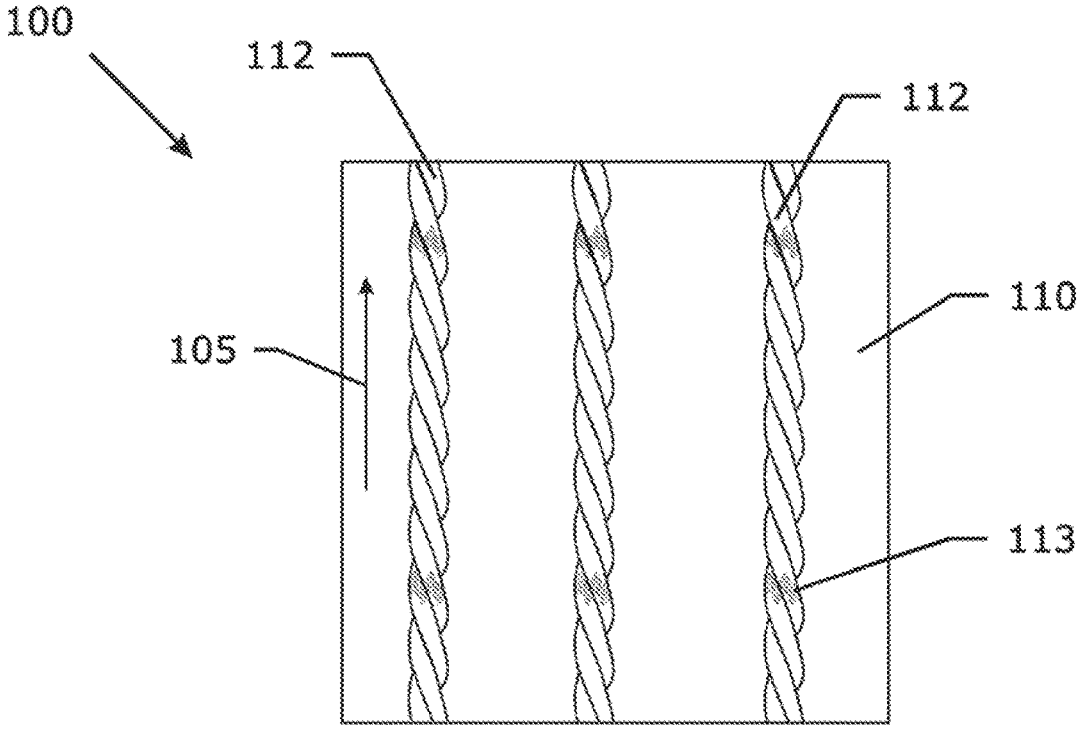

(51) Int. Cl.

| | |
|---|---|
| ***B21F 27/08*** | (2006.01) |
| ***E01C 11/00*** | (2006.01) |
| ***E01C 23/088*** | (2006.01) |
| ***E01C 23/12*** | (2006.01) |
| *E04C 5/04* | (2006.01) |
| *E04C 5/01* | (2006.01) |
| *E01C 9/00* | (2006.01) |

(52) U.S. Cl.
CPC ..... *E01C 23/088* (2013.01); *E01C 23/127* (2013.01); *E01C 9/00* (2013.01); *E01C 2201/167* (2013.01); *E04C 5/012* (2013.01); *E04C 5/04* (2013.01)

(58) Field of Classification Search
USPC ..... 404/70
See application file for complete search history.

(56) References Cited

U.S. PATENT DOCUMENTS 1,868,108 A * 7/1932 Lachman ..... E01C 11/16 29/513
1,975,281 A * 10/1934 Lumb ..... E01C 11/16 404/134
2,179,019 A * 11/1939 Willetts ..... E01C 11/18 404/31
4,081,159 A * 3/1978 Baldwin ..... B21F 27/06 140/24
4,096,680 A * 6/1978 Ritter ..... E04C 5/04 52/665
4,540,311 A * 9/1985 Leach ..... C09K 17/00 404/70
5,106,227 A * 4/1992 Ahmad ..... E01C 11/165 404/134
6,521,096 B1 * 2/2003 Jurvanen ..... D21D 5/16 156/172
6,846,537 B2 * 1/2005 Wheatley ..... B29C 73/10 428/40.1
7,168,884 B2 * 1/2007 Hart ..... E01C 3/06 404/28
8,142,102 B2 * 3/2012 Wheatley ..... E01C 11/005 404/31
8,677,725 B2 * 3/2014 Zaretsky ..... E04G 11/20 57/212
9,187,901 B2 * 11/2015 Ogden ..... E04C 5/04
2006/0049388 A1 * 3/2006 Knott, Jr. ..... E04C 5/04 254/400
2009/0120025 A1 * 5/2009 Sezen ..... E04C 3/20 52/340
2009/0263572 A1 * 10/2009 Wheatley ..... C04B 28/02 427/136
2010/0026048 A1 * 2/2010 Vlot ..... B32B 15/013 296/193.01
2015/0191878 A1 * 7/2015 White ..... E01C 11/16 404/70

FOREIGN PATENT DOCUMENTS

| | | | | |
|---|---|---|---|---|
| EP | 0 015 027 | | 9/1980 | |
| GB | 192198 | | 2/1923 | |
| GB | 367256 | A * | 2/1932 | ..... E01C 11/16 |
| GB | 810059 | A * | 3/1959 | ..... E01C 11/16 |
| KR | 10-2011-0137860 | | 12/2011 | |
| WO | 2014/161930 | | 10/2014 | |
| WO | WO-2016062458 | A1 * | 4/2016 | ..... E01C 11/16 |

* cited by examiner

STRUCTURE FOR THE REINFORCEMENT OF PAVEMENTS

TECHNICAL FIELD

The invention relates to a structure for the reinforcement of pavements and to a pavement reinforced with such structure. The invention also relates to a method of manufacturing such a structure. Furthermore the invention relates to a method of breaking up a pavement reinforced with such a structure.

BACKGROUND ART

Repairing roads by applying an overlay, such as an asphalt overlay, to the road surface is well known in the art. A serious drawback of this method includes reflective cracking. Reflective cracking is the process by which an existing crack, discontinuity or joint propagates towards the surface through an overlying layer of asphalt.

Once a reflective crack reaches the surface, an open path is created allowing the penetration of water into the lower layers of the pavement. Left untreated, this situation will lead to further deterioration of the pavement structure and to a reduction in overall serviceability. The use of interlayers, such as steel wire meshes, geogrids, non-woven structures and stress relieve membranes also called stress absorbing interlayers or SAMI has gained widespread acceptance.

Inevitably, with the passage of time and upon subjection to various forces during use, reinforced pavements suffer deterioration so that removal and replacement is required. Ease of removal and recyclability are therefore important issues.

Generally reinforced pavements are removed by milling and/or grinding machines.

It has been proven that reinforcement structures comprising elongated elements such as steel wires are very successful to reduce cracking in the overlay. The removal of roads reinforced with elongated elements—although possible—often implies problems such as the tangling of the elongated elements around the drum of a milling machine.

DISCLOSURE OF INVENTION

It is an object of the present invention to provide a structure for the reinforcement of pavements avoiding the drawbacks of the prior art. It is another object of the present invention to provide a structure for the reinforcement of pavements allowing easy breaking up of the reinforced pavement, allowing milling and grinding and allowing recycling. Furthermore it is an object to provide a method of breaking up a reinforced road.

According to a first aspect of the present invention a structure for the reinforcement of pavements is provided. The structure is at predetermined positions provided with interruptions or provided with weakened zones. For a person skilled in the art it is clear that a structure for the reinforcement of pavements can be provided with both interruptions and weakened zones.

The distance between two neighbouring interruptions or between two neighbouring weakened zones is preferably at least 1 cm. Preferably the distance between two neighbouring interruptions or between two neighbouring weakened zones ranges between 1 cm and 200 cm. More preferably, the distance between two neighbouring interruptions or between two neighbouring weakened zones ranges between 20 cm and 100 cm, e.g. between 25 cm and 80 cm and is for example equal to 30 cm, 40 cm, 50 cm, 60 cm, 70 cm, 80 cm or 90 cm.

The distance between two neighbouring interruptions can be measured in any direction, for example in the longitudinal direction (length direction) of the structure for the reinforcement of pavements or in the transversal direction of the structure for the reinforcement of pavements.

Preferably, the distance between two neighbouring interruptions or between two neighbouring weakened zones is measured in the longitudinal direction of the structure for the reinforcement of pavements. In the longitudinal direction of the structure for the reinforcement of pavements the distance between two neighbouring interruptions or between two neighbouring weakened zones is preferably ranging between 1 cm and 200 cm, e.g. between 20 cm and 100 cm, e.g. between 25 cm and 80 cm, and is for example equal to 20 cm, 30 cm, 40 cm, 50 cm, 60 cm, 70 cm, 80 cm, 90 cm or 100 cm.

The distance between consecutive neighbouring interruptions or between consecutive neighbouring weakened zones can be constant or can vary along the length of the structure for the reinforcement of pavements.

The length of a weakened zone itself may be very short. In principle, the weakened zone may be limited to a weakened point. The weakened zones have preferably a length of at least 1 mm, for example 2 mm, 3 mm, 4 mm or 5 mm.

For the purpose of this invention a weakened zone is defined as a zone having a lower strength compared to non-weakened zones or a zone having a higher brittleness compared to non-weakened zones. It is clear that a weakened zone may have both a lower strength and a higher brittleness compared to non-weakened zones.

In case the weakened zone is characterized by a lower strength, the strength (tensile strength) of the weakened zone is at least 10% lower than the strength of the non-weakened zones. More preferably, the strength of the weakened zones is at least 20%, at least 30%, at least 40%, at least 50%, at least 80% or at least 90% lower than the strength of the non-weakened zones.

The strength is tested in a tensile test.

With respect to brittleness, the quantitative measurement of the brittleness of a material is more difficult. A material is brittle, if when subjected to stress, it breaks without significant deformation (strain). For the purpose of this invention a weakened zone is defined as a zone of a structure for the reinforcement of pavements that will break when bent over a pulley having a diameter of 5 cm or lower, for example a pulley having a diameter of 4 cm or 3 cm.

Preferably, a structure for the reinforcement of pavements will not break at the weakened zones when bent over a pulley having a diameter higher than 5 cm, for example a pulley having a diameter of 10 cm.

By providing the structure for the reinforcement of pavements with weakened zones preferred zones for breaking are created. During removal of reinforced pavements the reinforcement structure will break at these predetermined positions of weakened zones.

As the length between weakened zones is limited, the length of the pieces of the reinforcement structure of a broken up reinforced pavement is limited. This simplifies the recycling of a reinforced pavement. Furthermore, as the length of the reinforced structure of a broken up reinforced pavement is limited, tangling of elongated elements of the reinforcement structure around the drum of a milling machine is avoided.

To provide the structure for the reinforcement of pavements structure with weakened zones any method allowing to obtain a structure having weakened zones can be considered. Possible methods comprise subjecting the zones to be weakened to a thermal treatment, a mechanical treatment or a chemical treatment. The thermal treatment may be done by induction heating or by electrical heating. Alternatively, a structure having weakened zones can be obtained by connecting or joining different parts together. This can for example be realized by any type of joining technique such as welding or gluing. The welded or glued zones form then the weakened zone.

The weakened zones may also be obtained by applying mechanical indentations.

In general, providing weakened zones may be done in a continuous way, e.g. during the manufacture of the structure, or in a discontinuous way, e.g. after a (non-weakened) structure has been made.

To provide the structure for the reinforcement of pavements with interruptions, any cutting or breaking technique can be considered.

The structure for the reinforcement of pavements comprises for example a metal material or a non-metal material, or comprises a combination of a metal material and a non-metal material.

Any metal can be considered as metal material. Preferably, the metal material comprises steel. The steel may comprise for example high carbon steel alloys, low carbon steel alloys or stainless steel alloys. Preferred non-metal material comprises polymers, glass for example glass filaments or glass rovings or carbon, for example carbon filaments or carbon rovings. Examples of polymers comprise polyethylene, polypropylene, and polyester.

The structure comprises for example a grid or a mesh, a woven or a non-woven structure or any combination thereof. As grid or mesh any type of grids or meshes can be considered, for example triangular, square, hexagonal or diamond grids or meshes. Examples comprise metal grids or metal meshes, glass grids or glass meshes or polymer grids or polymer meshes, carbon grids or carbon meshes.

In preferred embodiments, the structure comprises elongated elements. At least part of the elongated elements of this structure is provided with interruptions or with weakened zones at predetermined positions along the length of these elongated elements. Preferably, at least 20% of the elongated elements of the structure is provided with interruptions or weakened zones. More preferably, at least 50% of the elongated elements of the structure is provided with interruptions or weakened zones.

In a preferred embodiment all (100%) of the elongated elements are provided with interruptions or weakened zones.

For a person skilled in the art, it is clear that the elongated elements of such structure can be provided with both interruptions and weakened zones.

The distance between two neighbouring interruptions or between two neighbouring weakened zones of an elongated element ranges preferably between 1 cm and 200 cm. More preferably, the distance between two neighbouring interruptions or between two neighbouring weakened zones of an elongated element ranges between 20 cm and 100 cm, e.g. between 25 cm and 80 cm, and is for example equal to 40 cm, 50 cm, 70 cm, 80 cm or 90 cm.

The length of a weakened zone may be very short. In principle, the weakened zone may be limited to a weakened point. The weakened zones have preferably a length of at least 1 mm, for example 2 mm, 3 mm, 4 mm or 5 mm.

For the purpose of this invention a weakened zone of an elongated element is defined as a zone of an elongated element having a lower strength (tensile strength) compared to the non-weakened zones of this elongated element or a zone of the elongated element having a higher brittleness compared to the non-weakened zones. It is clear that a weakened zone of an elongated element may have both a lower strength and a higher brittleness compared to non-weakened zones.

In case the weakened zone is characterized by a lower strength, the strength (tensile strength) of the weakened zone of the elongated elements is at least 10% lower than the strength of the non-weakened zones of the elongated element. More preferably the strength of the weakened zones is at least 20%, at least 30%, at least 40%, at least 50%, at least 80% or at least 90% lower than the strength of the non-weakened zones. The strength is measured in a tensile test.

A weakened zone of an elongated element is considered as having a high brittleness when said elongated element breaks at this weakened zone when bent over a pulley having a diameter of 5 cm or lower, for example a pulley having a diameter of 4 cm or 3 cm.

Preferably, an elongated element will not break at its weakened zones when bent over a pulley having a diameter higher than 5 cm, for example a pulley having a diameter of 10 cm.

By providing the elongated elements of a structure for the reinforcement of pavements with weakened zones the elongated elements have preferred zones for breaking are created. During removal of reinforced pavements the elongated elements will break at these predetermined positions of weakened zones.

As the length between weakened zones is limited, the length of the pieces of the elongated elements of a broken up reinforced pavement is limited. This simplifies the recycling of a reinforced pavement.

Furthermore, as the length of the elongated elements of a broken up reinforced pavement is limited, tangling of elongated elements of the reinforcement structure around the drum of a milling machine is avoided.

To provide the elongated elements of a structure for the reinforcement of pavements with weakened zones any method allowing to obtain elongated elements having weakened zones can be considered. Possible methods comprise subjecting the zones to be weakened to a thermal treatment, a mechanical treatment or a chemical treatment. Alternatively, elongated elements having weakened zones can be obtained by connecting or joining different parts together. This can for example be realized by any type of joining technique such as welding or gluing. The welded or glued zones form then the weakened zone.

To provide the elongated elements of a structure for the reinforcement of pavements with interruptions, any cutting or breaking technique can be considered.

The elongated elements may comprise elongated metal elements or elongated non-metal elements. It is clear that a structure comprising a combination of elongated metal elements and elongated non-metal elements can be considered as well.

Any structure comprising elongated metal elements can be considered.

Examples of structures comprise structures comprising parallel or substantially parallel elongated metal elements, meshes, woven structures, knitted structures . . .

Preferred meshes include welded or woven meshes such as hexagonal woven mesh.

Preferably, the structure has a fabric with elongated longitudinal reinforcing elements that are running substantially parallel in longitudinal direction and elongated transverse reinforcing elements are running substantially parallel in transverse direction. The elongated longitudinal and transverse reinforcement elements may be metal wires, metal bundles or metal cords, carbon fibers, synthetic fibers or glass fibers or yarns made therefrom. Preference is given to steel cords since steel cords both have a high strength and flexibility due to its twisting of thin wires or filaments. The steel cords may have any construction such as a 3×1, a 4×1, a 1+6, a 2+2, . . .

Usually the elongated longitudinal reinforcement elements and the elongated transverse reinforcement elements have a spacing in-between ranging from 15 mm to 75 mm, e.g. from 20 mm to 70 mm, e.g. from 25 mm to 65 mm.

Most preferably, the structure further comprises a substrate or a carrier positioned under the reinforcement elements. This substrate can be a non-woven or a plastic grid. The nonwoven may be of polyethylene, polypropylene, polyethyleneterephtalaat, polylactic acid, polyamide, . . . or combinations thereof. The nonwoven may be spunbond, needle-punched, spunlaced, The plastic grid may be made of polyethylene, polypropylene, polyethyleneterephtalate, polylactic acid, polyamide, . . . or combinations thereof. The plastic grid may be woven, extruded, thermobonded, . . . The advantage of a substrate is dimensional stability together with a lightweight open structure. The non-woven version has the advantage that the tack coat which is applied as first layer above the road to be renovated, may penetrate in the substrate and thus assures a good adhesion during installation. The plastic grid has the advantage that it is widely available and is cheap.

Elongated Metal Elements

As elongated metal element any type of elongated metal elements can be considered. Examples comprise metal bars, metal wires, assemblies of grouped metal elements such as parallel metal wires or metal wires twisted together to form cords.

Elongated metal elements may comprise any type of metal. Preferably, the metal material comprises steel. The steel may comprise for example high carbon steel alloys, low carbon steel alloys or stainless steel alloys.

The elongated metal elements have a diameter preferably ranging between 0.04 mm and 8 mm. More preferably, the diameter of the filaments ranges between 0.3 mm and 5 mm as for example 0.33 mm or 0.37 mm.

The elongated metal elements preferably have a circular or substantially circular cross-section although elongated metal elements with other cross-sections, such as flattened elements or elements having a square or substantially square cross-section or having a rectangular or substantially rectangular cross-section can be considered as well.

The elongated metal elements can be uncoated or can be coated with a suitable coating, for example a coating giving corrosion protection. Suitable coatings comprise a metal coating or a polymer coating. Examples of metal or metal alloy coatings comprise zinc or zinc alloy coatings, for example brass coatings, zinc aluminium coating or zinc aluminium magnesium coatings. A further suitable zinc alloy coating is an alloy comprising 2 to 10% Al and 0.1 to 0.4% of a rare earth element such as La and/or Ce.

Examples of polymer coatings comprise polyethylene, polypropylene, polyester, polyvinyl chloride or epoxy.

For a person skilled in the art it is clear that a coating such as a coating giving corrosion protection can be applied on the elongated metal elements. However, it is also possible that a coating is applied on an assembly of grouped elongated metal elements.

For the purpose of this invention with "an assembly of grouped metal elements" is meant any unit or group of a number of metal elements that are assembled or grouped in some way to form said unit or said group. The metal elements of an assembly of grouped metal elements can be assembled or grouped by any technique known in the art, for example by twisting, cabling, bunching, gluing, welding, wrapping, . . .

Examples of assemblies of grouped metal elements comprise bundles of parallel or substantially parallel metal elements, metal elements that are twisted together for example by cabling or bunching such as strands, cords or ropes. As cords either single strand cords as multistrand cords can be considered.

Structures for the reinforcement of pavement comprising bundles of parallel or substantially parallel elements or comprising cords have the advantage that they can easily be rolled up and rolled out. Furthermore such structures have the advantage that they lie in a flat position when rolled out and remain in this flat position without requiring additional precautions or steps to obtain or maintain this flat position. Structures comprising bundles of parallel or substantially parallel elements have the additional advantage that the bundles may have a limited thickness as all elements can be positioned next to each other.

The number of elongated metal elements in an assembly of grouped elongated metal elements ranges preferably between 2 and 100, for example between 2 and 81, between 2 and 20, for example 6, 7, 10 or 12.

All elongated metal elements of an assembly of grouped metal elements may have the same diameter. Alternatively, an assembly of grouped metal elements may comprise elongated metal elements having different diameters.

An assembly of grouped elongated metal elements may comprise one type of elements. All elongated metal elements of an assembly have for example the same diameter and the same composition. Alternatively, an assembly of grouped elongated metal elements may comprise different types of elongated metal elements, for example elements having different diameters and/or different compositions. An assembly of grouped elongated metal elements may for example comprise elongated non-metal elements next to the elongated metal elements. Examples of elongated non-metal elements comprise carbon or carbon based filaments or yarns, polymer filaments or polymer yarns, such as filaments or yarns made of polyamide, polyethylene, polypropylene or polyester. Also glass yarns or rovings of glass filaments can be considered.

The elongated metal elements preferably have a tensile strength higher than 1000 MPa, for example higher than 1500 MPa or higher than 2000 MPa.

The weakened zones of an elongated metal element preferably have a tensile strength being at least 10% lower than the tensile strength of the elongated metal elements. More preferably, the weakened zones have a tensile strength being at least 20%, at least 30%, at least 40%, at least 50%, at least 80% or at least 90% lower than the tensile strength of the elongated metal elements.

Alternatively, the weakened zones of an elongated metal element have a higher brittleness than the non-weakened zones of this elongated metal element.

By providing the structure or the elongated elements of such a structure with weakened zones or with interruptions, the structure for the reinforcement of pavements will break at these predetermined positions during removal of the reinforced pavements.

As the elongated metal elements break at the weakened zones the length of the elongated metal elements once broken will be limited. Elongated metal elements of limited length can be removed more easily.

Furthermore as the length of the elongated metal elements will be limited tangling of the elongated metal elements, for example around the drum of a milling machine during breaking up of the reinforced pavement is avoided.

Preferred methods for weakening the elongated metal elements at predetermined positions along the length of the elongated metal elements comprise subjecting the zones to be weakened to a thermal treatment, a mechanical treatment or a chemical treatment.

Thermal treatments may comprise any type of heating or welding, e.g. heating by induction or electrical resitance heating. Examples comprise induction heating, laser heating, spot welding or roll welding.

Chemical weakening comprises for example the local weakening by means of a chemical agent, for example an acid.

Mechanical weakening comprises for example bending, deforming, elongating, providing the elongated metal element with indentations or incisions.

Alternatively, elongated metal elements provided with weakened zones at predetermined positions along the length of the elongated metal elements can be obtained by connecting or joining different parts of elongated metal elements together. This can for example be realized by any type of joining technique such as welding or gluing. In such case, the welded or glued zones form then the weakened zones.

Preferred methods for providing the elongated metal elements at predetermined positions along the length of the elongated metal elements with interruptions comprise cutting the elongated metal elements at predetermined positions.

Elongated Non Metal Elements

As elongated non metal element any type of elongated non metal elements can be considered. Examples comprise bars, wires, assemblies of grouped elements such as parallel filaments or filaments twisted together to form cords.

Elongated non metal elements may comprise any type of non metal material. Preferably, the non metal material comprises polymer material, glass or carbon.

The polymer material comprises for example polyethylene, polypropylene or polyester, polyamide or polyvinyl alcohol. The elongated polymer elements comprise for example polymer filaments or yarns.

Elongated glass elements comprise for example glass filaments or glass rovings. Elongated carbon elements comprise for example carbon fibers or carbon filaments or carbon rovings.

The weakened zones of an elongated non metal element preferably have a tensile strength being at least 10% lower than the tensile strength of the elongated non metal elements. More preferably, the weakened zones have a tensile strength being at least 20%, at least 30%, at least 40%, at least 50%, at least 80% or at least 90% lower than the tensile strength of the elongated non metal elements.

Alternatively, the weakened zones of an elongated non metal element have a higher brittleness than the non-weakened zones of this elongated non metal element.

The elongated non metal elements can be weakened at predetermined positions along the length of the elongated non metal elements by the same or similar methods used for the weakening of elongated metal elements, for example by a thermal treatment, a mechanical treatment or a chemical treatment.

Alternatively, elongated non metal elements provided with weakened zones at predetermined positions along the length of the elongated metal elements can be obtained by connecting or joining different parts of elongated non metal elements together. This can for example be realized by any type of joining technique such as welding or gluing. In such case, the welded or glued zones form then the weakened zones.

Preferred methods for providing the elongated non metal elements at predetermined positions along the length of the elongated non metal element with interruptions comprise cutting the elongated non metal elements at predetermined positions.

Any structure comprising elongated non metal elements can be considered. Examples of structures are structures comprising parallel or substantially parallel elongated non metal elements, meshes, woven structures, knitted structures . . .

According to a second aspect of the present invention methods to manufacture a structure for the reinforcement of pavements is provided. In a first method of manufacturing a structure for the reinforcement of pavements first the structure for the reinforcement of pavements is manufactured and this structure is interrupted or weakened at predetermined positions in a subsequent step.

In a second method of manufacturing a structure for the reinforcement of pavements elongated elements are provided. These elongated elements are interrupted or weakened at predetermined positions and a structure for the reinforcement of pavements comprising these elongated elements is manufactured.

The first method of manufacturing a structure for the reinforcement of pavements comprises the steps of

- manufacturing a structure for the reinforcement of pavements;
- providing said structure at predetermined positions with interruptions or with weakened zones.

The second method of manufacturing a structure for the reinforcement of pavements comprises the steps of

- providing elongated elements, for example elongated metal elements;
- providing said elongated elements at predetermined positions along the length of said elongated elements with interruptions or weakened zones;
- manufacturing a structure for the reinforcement of pavements comprising said elongated elements provided with weakened zones.

Possibly this second method further comprises the step of

- providing said structure at predetermined positions along the length of said structure with interruptions or with weakened zones.

According to a third aspect of the present invention a reinforced pavement is provided. The reinforced pavement comprises

- a pavement
- a structure for the reinforcement of pavements according to the present invention;
- an overlay applied over said structure for the reinforcement of pavements.

The pavement comprises for example a concrete or asphalt pavement. The overlay comprises for example a concrete overlay or an asphalt overlay.

In a preferred embodiment the reinforced pavement further comprises an interlayer between said pavement and said structure for the reinforcement of pavements and/or between said structure for the reinforcement of pavements and said overlay. The interlayer comprises for example a binding layer or a tack layer.

According to a fourth aspect a method of breaking up a pavement reinforced with a structure for the reinforcement of pavements as described before is provided. The method of breaking up a reinforced pavement comprises the step of milling the surface of said pavement thereby allowing the structure for the reinforcement of pavements to break at said predetermined positions of said weakened zones.

The presence of the structure for the reinforcement of pavements will not complicate the breaking up as the structure or the elongated elements of this structure is/are provided with interruptions or with weakened zones. The presence of interruptions or weakened zones guarantees that the length of the pieces of the broken up structure for the reinforcement of pavements remains limited.

In a preferred method the breaking up of the pavement reinforced with a structure for the reinforcement of pavements is broken up by a milling machine comprising a milling drum. The milling drum comprises preferably a rotary milling drum provided with a plurality of cutting teeth. Such method comprises the steps of

- providing a milling machine comprising a milling drum;
- moving said milling machine over the surface of the reinforced pavement to be milled, thereby rotating the milling drum to cut into the surface of the reinforced pavement to a desired depth as the milling machine is advanced along the reinforced pavement and allowing the structure for the reinforcement of pavements to break at said predetermined positions.

As the length of the pieces of the broken up structure for the reinforcement of pavements remains limited, entangling around the drum of the milling machine is avoided.

Possibly, the top layer of the reinforced pavement is milled to a depth close to the structure for the reinforcement of pavements in a first step and the layer comprising the structure for the reinforcement of pavements is milled in a subsequent step.

Structures for the reinforcement of pavements comprising steel have the advantage that the steel can be removed easily and efficiently from the milled material by means of magnets. This results in a higher purity of the milled asphalt or concrete and guarantees the reusability of the milled asphalt or concrete.

BRIEF DESCRIPTION OF FIGURES IN THE DRAWINGS

Figure 8:
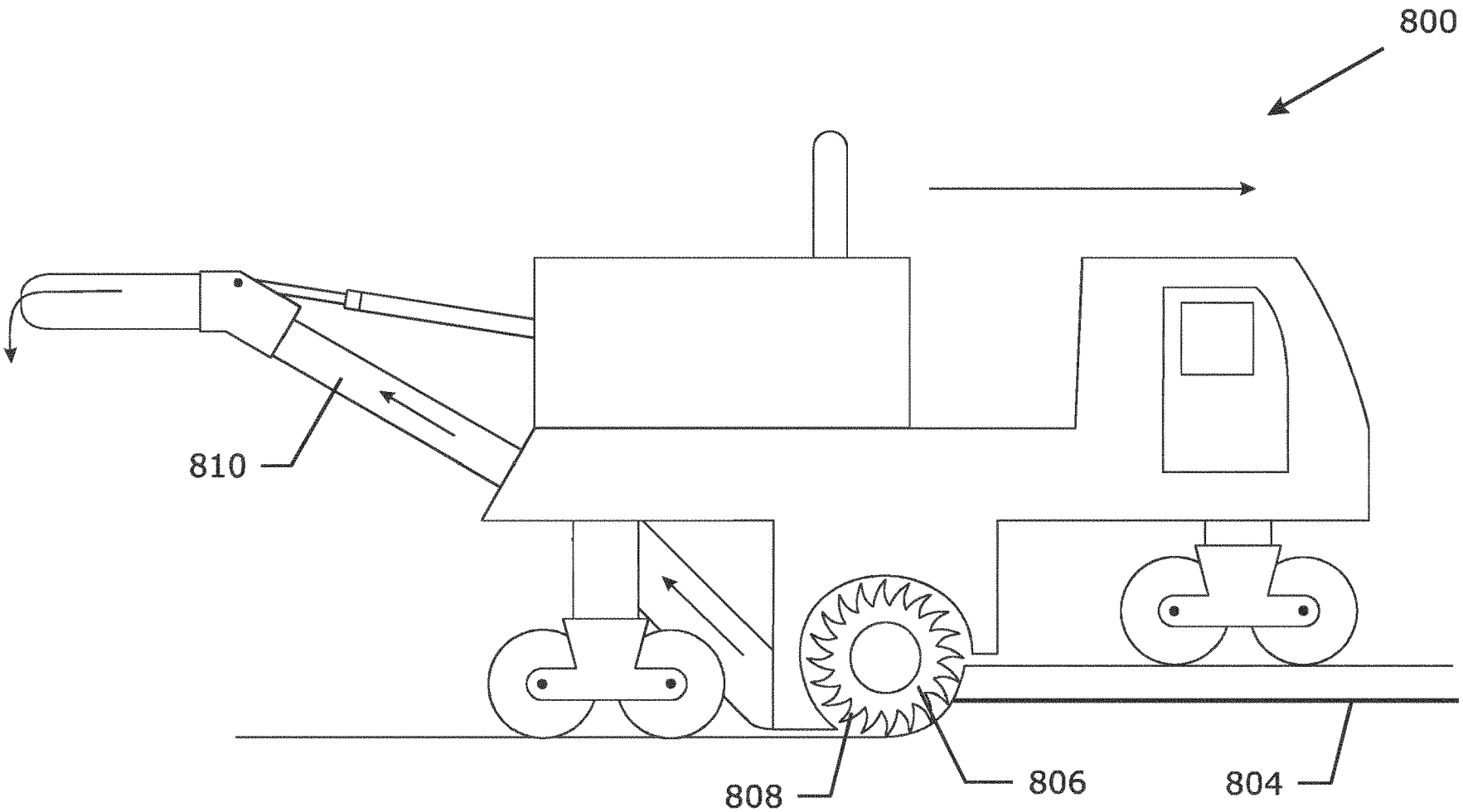

The invention will now be described into more detail with reference to the accompanying drawings whereby FIG. 1, FIG. 2, FIG. 3, FIG. 4, FIG. 5, FIG. 6, FIG. 7*a*, FIG. 7*b* and FIG. 7*c* are schematic illustrations of embodiments of structures for the reinforcement of pavements according to the present invention;

FIG. 8 is a schematic illustration of a method of breaking up a reinforced pavement comprising a structure for the reinforcement of pavements according to the present invention.

MODE(S) FOR CARRYING OUT THE INVENTION

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

For the purpose of this invention "pavement" means any paved surface. The pavement is preferably intended to sustain traffic, such as vehicular or foot traffic.

Examples of pavements comprise roads, walkways, parking lots, airport runways, airport taxiways, harbour pavements, . . .

FIG. 1 is a schematic illustration of a first embodiment of a structure 100 for the reinforcement of pavements according to the present invention. The structure 100 comprises assemblies of grouped elongated metal elements 112. The assemblies of grouped elongated metal elements 112 are provided with weakened zones 113 at predetermined positions along the length of these assemblies 112. The distance between neighbouring weakened zones 113 measured along the longitudinal direction of structure 100 is for example 20 cm, 30 cm, 40 cm, 50 cm, 60 cm, 70 cm, 80 cm, 90 cm or 100 cm.

The assemblies of grouped elongated metal elements 112 may comprise steel cords. A preferred steel cord comprises between 2 and 12 filaments, for example a cord having one core filament having a diameter of 0.37 mm and 6 filaments having a diameter of 0.33 mm around this core filament (0.37+6×0.33).

In an alternative embodiments the assemblies of grouped elongated metal elements 112 comprise bundles of parallel or substantially parallel elongated metal elements, for example bundles of 12 parallel or substantially parallel elongated metal elements.

The assemblies of grouped elongated metal elements 112 are all oriented parallel or substantially parallel to each other. The orientation of these assemblies 112 corresponds with the longitudinal direction 105 of structure 100.

The assemblies of grouped elongated metal elements can be coupled to or integrated to a substrate 110. In the embodiment shown in FIG. 1 the assemblies 112 are glued to substrate 110.

The substrate 110 may for example comprise a polymer material, glass, carbon or any combination thereof. The substrate 110 is for example a grid or foil obtained by extrusion. Alternatively, the substrate 110 comprises a woven or non-woven structure, for example a woven or non-woven polymer structure. Examples of non-woven structures comprise a needle-punched or spunbond non-woven substrate, for example in polyamide, polyester (for example polyethylene terephthalate (PET)), polyethylene or polypropylene.

In a preferred embodiment the assemblies of grouped elongated metal elements 112 comprise steel cords twisted elongated metal filaments glued to a polymer substrate 110 for example a non-woven polyether sulphone substrate or an extruded polypropylene grid (35 g/m$^2$ having a 6×6 mm mesh).

In another preferred embodiment the assemblies of grouped elongated metal elements 112 comprise steel cords glued to a substrate 110 made of glass fibers or glass rovings or to a substrate comprising carbon filaments.

Figure 2:
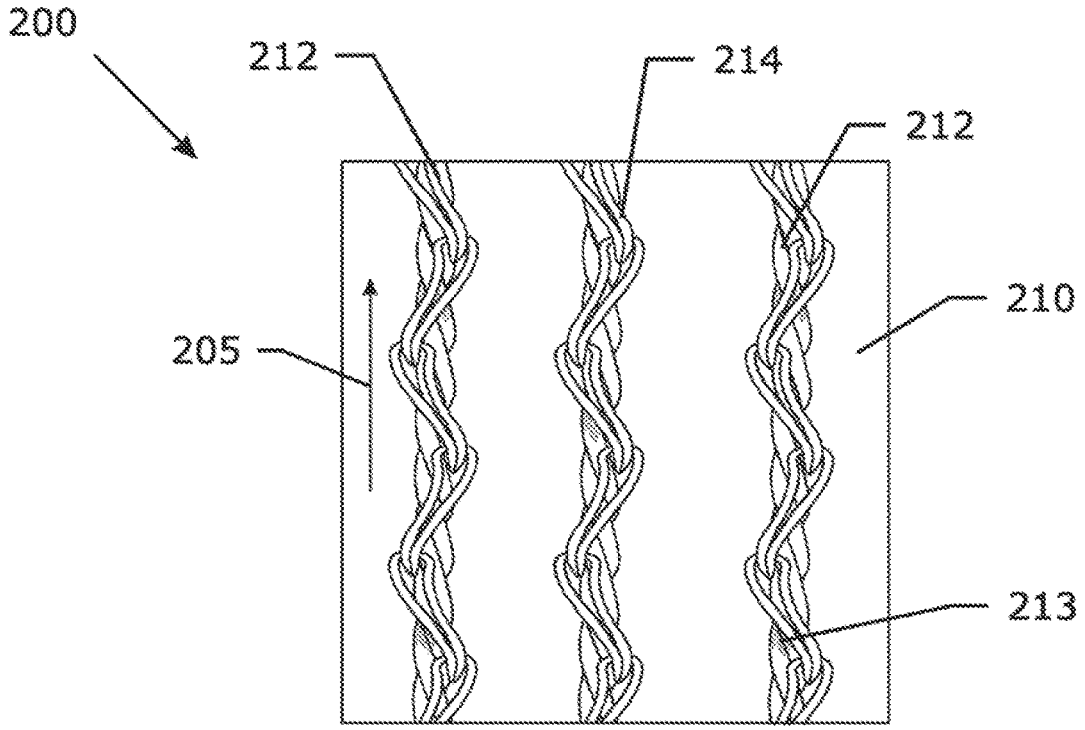

FIG. 2 is an illustration of a second embodiment of a structure 200 for the reinforcement of pavements according to the present invention. The structure 200 comprises a group of assemblies of grouped elongated metal elements 212. The assemblies 212 are provided with weakened zones 213 at predetermined positions along the length of these assemblies 212.

The assemblies of grouped elongated metal elements 212 may comprise steel cords. The assemblies of grouped elongated metal elements comprise for example steel cord comprising 3 filaments having a diameter of 0.48 mm twisted together (3×0.48 mm).

In alternative embodiments the assemblies of grouped elongated metal elements 212 comprise parallel or substantially parallel filaments, for example a bundle of 12 parallel or substantially parallel filaments.

The assemblies of grouped elongated metal elements 212 are all oriented parallel of substantially parallel to each other. The orientation of these assemblies 212 corresponds with the longitudinal direction 205 of structure 200.

The assemblies 212 are coupled to a substrate 210 by means of stitches 214. The stitches 214 are preferably formed by a yarn. The yarn comprises for example a multifilament yarn, preferably a polyamide, a polyester (for example polyethylene terephthalate (PET)), a polyvinyl alcohol or a polypropylene yarn.

The yarn may be provided with weakened zones. Alternatively, the yarn is not provided with weakened zones.

The substrate 210 comprises for example a woven or non-woven structure, for example a woven or non-woven polymer structure. Examples of non-woven structures comprise a needle-punched or spunbond non-woven substrate, for example in polyamide, polyester (for example polyethylene terephthalate (PET)), polyethylene or polypropylene.

In a preferred embodiment the assemblies of grouped elongated metal elements 212 comprise steel cords comprising twisted steel filaments. The steel cords are stitched to a polymer substrate 210 for example a non-woven polyether sulphone substrate by means of a polyester yarn 214 (for example polyethylene terephthalate).

Figure 3:
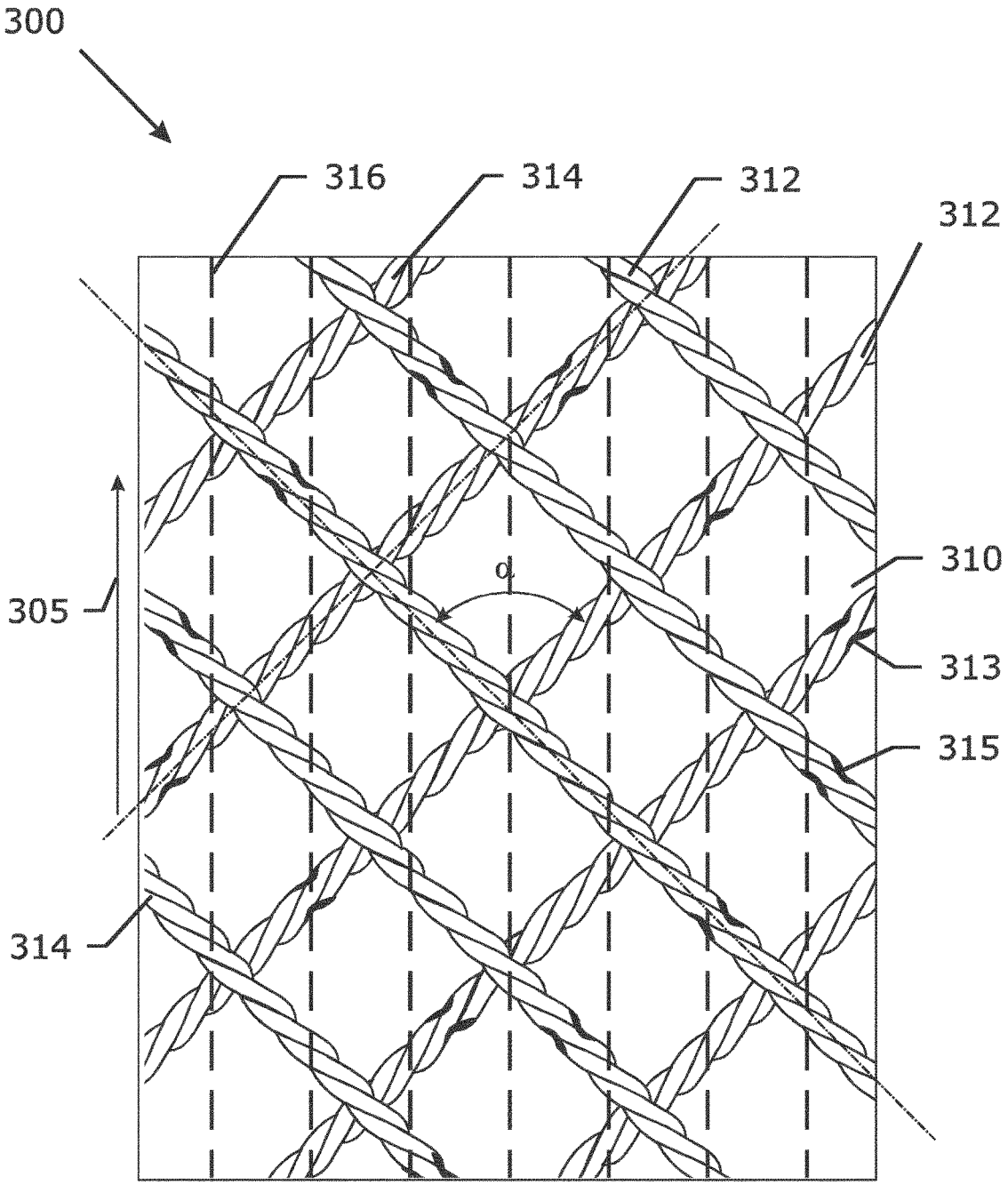

FIG. 3 is a further illustration of a structure 300 for the reinforcement of pavements. The structure 300 comprises a first group of assemblies of grouped elongated metal elements 312 and a second group of assemblies of grouped elongated metal elements 314. The first group of assemblies 312 comprises steel cords oriented substantially parallel to each other in a first direction. The first group of assemblies 312 is provided with weakened zones 313 at predetermined positions along the length of the assemblies 312. In the embodiment shown in FIG. 3, the weakened zones 313 are zones of the assemblies 312 provided with indentations or zones having a reduced diameter.

The second group of assemblies 314 comprises steel cords oriented substantially parallel to each other in a second direction. The second group of assemblies 314 is provided with weakened zones 315 at predetermined positions along the length of the assemblies 314. The weakened zones 315 are zones of the assemblies 314 provided with indentations or zones having a reduced diameter.

The first direction is different from the second direction. The included angle between the first direction and the longitudinal direction 305 of the structure 300 is 45 degrees. The included angle between the first direction and the section direction is indicated by $\alpha$. The included angle $\alpha$ is 90 degrees.

The assemblies of the first group 312 and the assemblies of the second group 314 are stitched to a substrate 310 along lines 316 by at least one yarn. The substrate 310 comprises for example a woven or non-woven structure.

Either the assemblies 312 of the first group or the assemblies 314 of the second group are provided with weakened zones 313, 315 along the length of the assemblies 312, 314. In a preferred embodiment both the assemblies 312 of the first group and the assemblies 314 of the second group are provided with weakened zones 313, 315.

For a person skilled in the art it is clear that it is also possible to provide either the first group of assemblies 312 or the second group of assemblies with weakened zones 313, 315.

Figure 4:
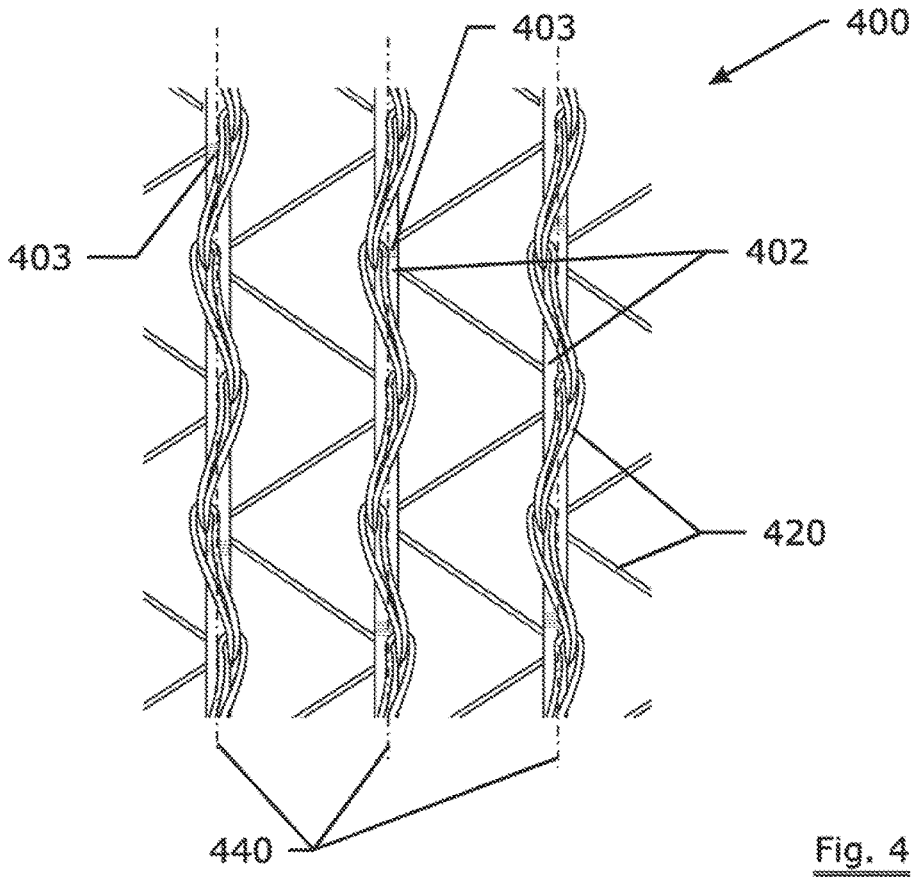

FIG. 4 shows a schematic illustration of a structure 400 for the reinforcement of pavements. The structure 400 is a knitted structure. The knitted structure 400 comprises a number of assemblies of grouped elongated metal elements 402 in parallel or mutual substantially parallel position. The assemblies of grouped elongated metal elements 402 are provided with weakened zones 403 at predetermined positions along the length of these assemblies 402.

In the knitted structure 400 shown in FIG. 4 the assemblies of grouped elongated metal elements are worked in to the loop of stitches 420 at the stitch line 440. The stitches 420 are formed by a yarn, for example a single or multifilament yarn, preferably a polyamide, a polyester (for example polyethylene terephthalate (PET)), a polypropylene yarn or a metal yarn such as a steel yarn. The yarn of the stitches 420 may or may not be provided with weakened zones.

The textile stitches shown in this example are in a tricot configuration. Preferred assemblies of grouped elongated metal elements 402 comprise steel cords.

Figure 5:
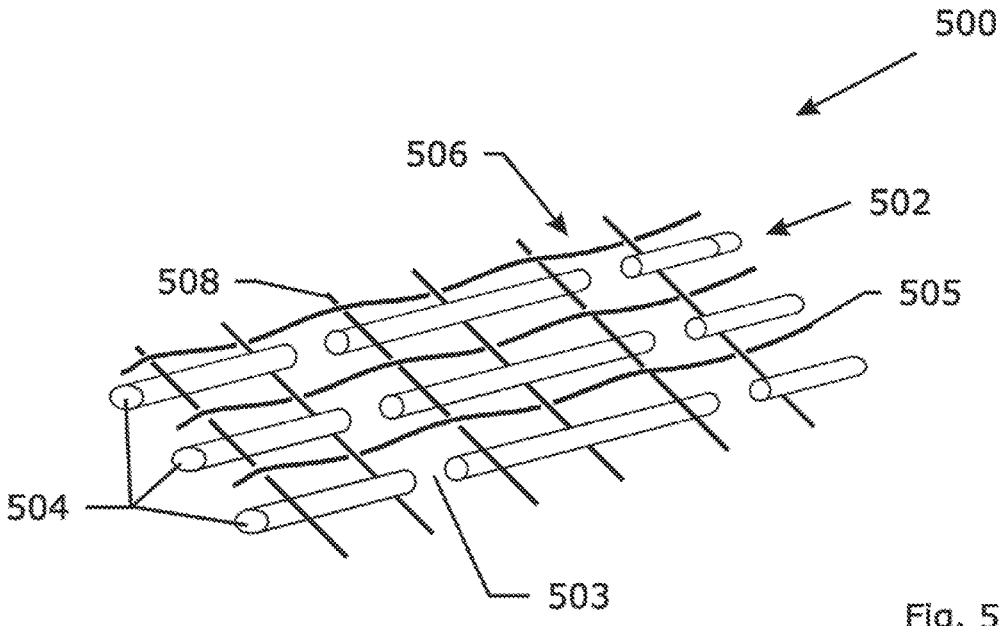

FIG. 5 is a schematic illustration of a structure 500 for the reinforcement of pavements. The structure 500 comprises a woven structure having in warp direction 502 a number of assemblies 504 of grouped elongated metal filaments, for example a number of steel cords. The assemblies of 504 are provided with interruptions 503 along their length. The warp direction 502 may further comprise a yarn (a binding warp filament) 505, for example between two assemblies of grouped metal filaments 502. The yarn 505 may or may not be provided with weakened zones or with interruptions.

The weft direction 506 comprises yarns, for example polyamide monofilaments (70 tex) 508. The structure 500 has for example a plain weave pattern. The elements of the weft direction may or may not be provided with weakened zones or with interruptions.

Figure 6:
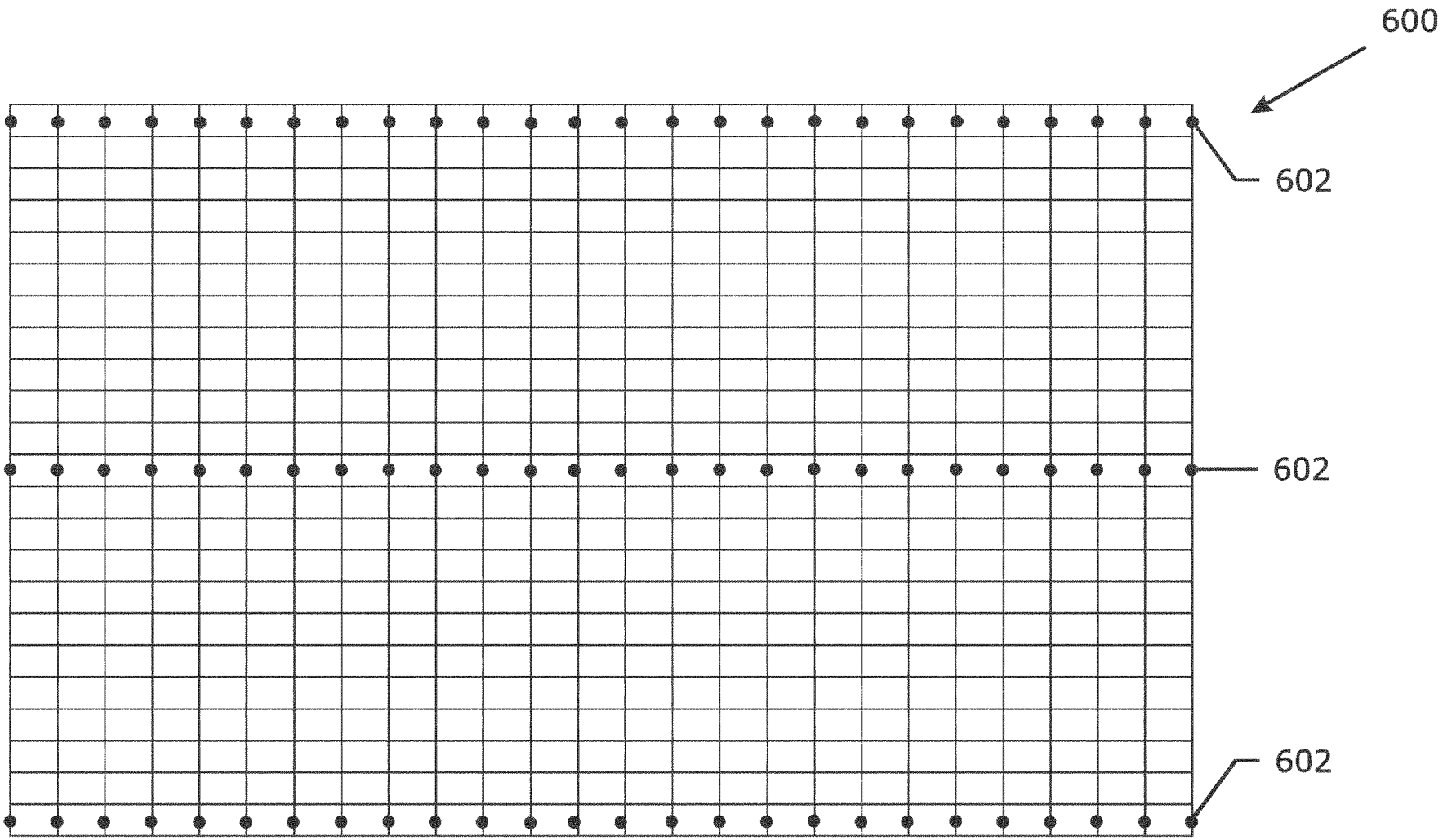

FIG. 6 is a schematic illustration of a structure 600 for the reinforcement of pavements. The structure 600 comprises a polyester grid, for example a polyethylene terephthalate (PET) grid. The structure 600 is at predetermined positions provided with weakened zones 602.

Figure 7A:
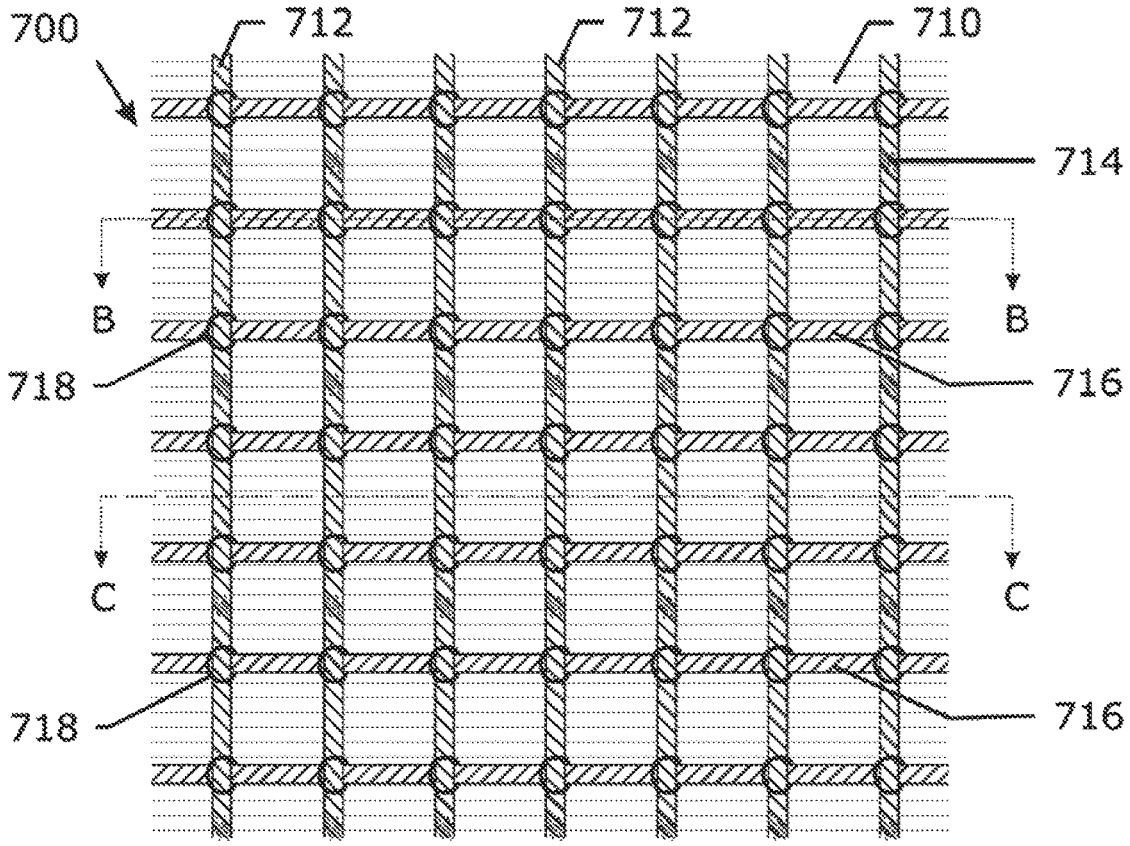
Figure 7B:
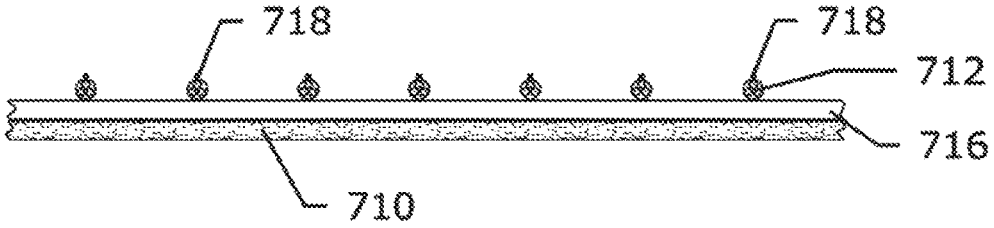
Figure 7C:
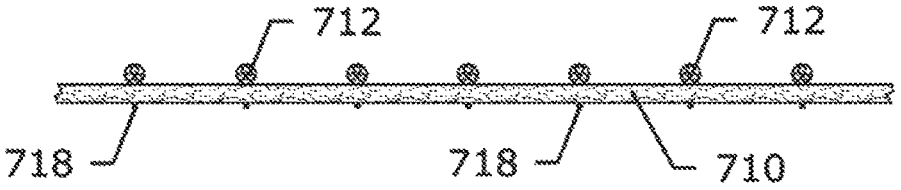

FIGS. 7*a*, 7*b* and 7*c* illustrate a preferable embodiment of the a structure 700 for the reinforcement of pavements. FIG. 7*a* is a schematic illustration, FIG. 7*b* shows a cross-section according to plane B-B and FIG. 7*c* shows a cross-section according to plane C-C.

Structure 700 comprises a substrate 710 as carrier in the form of a plastic grid or a non-woven. The structure 700 further comprises steel cords 712 substantially parallel to each other in the longitudinal direction. The transversal distance between two neighbouring steel cords 712 may range between 25 cm and 60 cm. These steel cords 712 are provided with weakened spots 714, e.g. at distances ranging between 40 cm and 60 cm. The structure 700 also comprises steel cords 716 substantially parallel to each other in the transverse direction. The longitudinal distance between two neighbouring steel cords 716 ranges between 25 cm and 60 cm. The transversal steel cords 716 may also be provided with weakened spots or interruptions (not shown). Synthetic yarns 718 hold the substrate 710, the steel cords 712 and the steel cords 716 together in a way that is best seen on FIG. 7*b* and FIG. 7*c*. The substrate 710 forms the basis.

The transverse steel cords 716 are positioned upon the substrate 710. The longitudinal steel cords 712 are positioned upon the transverse steel cords 716. The yarns 718 are stitched along the longitudinal steel cords 712 and and stitch the longitudinal steel cords 712 to the substrate 710.

In principle, no additional yarns or alternative adhesive means are needed for the transverse steel cords 716, since these steel cords 716 lie under the longitudinal steel cords 712.

However, additional stitches by means of additional yarns may fix the transverse steel cords 716 separately. Alternatively additional stitching may be provided at the cross-over points of the longitudinal steel cords 712 and the transverse steel cords 716.

FIG. 8 is a schematic illustration of a method of breaking up a pavement 802 reinforced with a reinforcement structure 804 according to the present invention. The pavement 802 is milled using a milling machine 800. The milling machine 800 comprises a milling drum 806 provided with cutting teeth 808. As the milling machine 800 is advancing over the surface of the reinforced pavement 802, the milling drum 806 is rotating over the surface of the reinforced pavement 802 and the milling drum 806 is cutting material from the surface of the reinforced pavement 802 to a desired depth. By the milling process the pavement 802 comprising the reinforcement structure 804 is ground or broken up into small pieces. As the reinforcement structure 804 is provided at predetermined positions with weakened zones, the reinforcement structure 804 will break at these predetermined positions during the milling process. Consequently, the length of the broken pieces of the reinforcement structure 804 is limited so that entanglement of broken pieces of the reinforcement structure 804 for example around the milling drum 806 of the milling machine 800 is avoided.

Generally, the milling machine 800 includes a conveyor system 810 designed to carry the milled material and to move the material for example to a truck. The material can be incorporated into new pavement or can be recycled.

In case the reinforcement structure comprises steel, it may be advantageous to provide the conveyor system 810 with magnets (not shown). The magnets allow to separate the steel from the milled material resulting in a higher purity of the milled pavement material.

Also the breaking unit or breaking units can be provided with magnets, instead of or in addition to the magnets of the conveyor system 810.

The invention claimed is:

1. A structure for the reinforcement of pavements, wherein said structure comprises elongated elements, wherein said elongated elements comprise steel bars, steel wires or assemblies of grouped steel wires, said elongated elements being at predetermined positions along the length of said elongated elements provided with weakened zones to prevent said elongated elements from tangling around the drum of a milling machine, said weakened zones being created by heating or welding, wherein said elongated elements provided with weakened zones break at said weakened zones when bent over a pulley having a diameter of 5 cm or lower.

2. A structure according to claim 1, wherein said structure comprises a grid or a mesh.

3. A structure according to claim 1, wherein the distance between two neighbouring weakened zones of said structure or between two neighbouring weakened zones of said elongated element ranges between 1 and 200 cm.

4. A structure according to claim 1, wherein said elongated elements have a tensile strength higher than 1000 MPa.

5. A structure according to claim 1, wherein said weakened zones have a tensile strength being at least 10% lower than the tensile strength of said elongated elements.

6. A method of manufacturing a structure for the reinforcement of pavements as defined in claim 1, said method comprising the steps of:

manufacturing a structure for the reinforcement of pavements; and providing said structure at predetermined positions with weakened zones.

7. A method of manufacturing a structure for the reinforcement of pavements as defined in claim 1, said method comprising the steps of:

providing elongated elements, wherein said elongated elements comprise steel bars, steel wires, or assemblies of grouped steel wires;

providing said elongated elements at predetermined positions along the length of said elongated elements with weakened zones; and manufacturing a structure for the reinforcement of pavements comprising said elongated elements provided with weakened zones.

8. A reinforced pavement comprising a pavement;

a structure for the reinforcement of pavements as defined in claim 1;

an overlay applied over said structure for the reinforcement of pavements.

9. A method of breaking up a pavement reinforced with a structure for the reinforcement of pavements as defined in claim 1, said method comprising the step of milling the surface of said pavement thereby allowing the structure for the reinforcement of pavements to break at said predetermined positions.

10. A method of breaking up a pavement according to claim 9, providing a milling machine comprising a milling drum;

moving said milling machine over the surface of the reinforced pavement to be milled thereby rotating the milling drum to cut into the surface of the reinforced pavement to a desired depth as the milling machine is advanced along the reinforced pavement and allowing the structure for the reinforcement of pavements to break at said predetermined positions.

11. A structure according to claim 1, wherein said heating is done by induction heating, laser heating or by electrical resistance heating.

12. A structure according to claim 1, wherein said welding is done by spot welding or roll welding.

13. A structure according to claim 1, said elongated elements having non-weakened zones next to said weakened zones and wherein said weakened zones have a higher brittleness than the non-weakened zones.

14. A structure according to claim 1, wherein said elongated elements are assemblies of grouped steel wires.

15. A structure according to claim 14, wherein said assemblies of grouped steel wires are steel cords.

16. A structure according to claim 1, wherein said assemblies of grouped steel wires are steel wires with a diameter ranging between 0.3 mm and 5.0 mm.

17. A structure according to claim 1, wherein said weakened zones have a first brittleness or a first strength, the rest of said elongated elements having a second brittleness or second strength, said first brittleness or first strength being different from said second brittleness or second strength.

* * * * *